US009637276B2

(12) United States Patent
Dais et al.

(10) Patent No.: US 9,637,276 B2
(45) **Date of Patent: *May 2, 2017**

(54) STAND-UP PLASTIC STORAGE BAG

(71) Applicant: S.C. Johnson & Son, Inc., Racine, WI (US)

(72) Inventors: Brian C. Dais, Saginaw, MI (US); Jose Porchia, Saginaw, MI (US); Andrew S. Weiss, Bay City, MI (US); Sanjay Dhall, Canton, MI (US); Saleem Qureshi, Canton, MI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/264,625

(22) Filed: Sep. 14, 2016

(65) Prior Publication Data

US 2017/0001760 A1 Jan. 5, 2017

Related U.S. Application Data

(63) Continuation of application No. 14/204,075, filed on Mar. 11, 2014, now Pat. No. 9,505,525.

(51) Int. Cl.
*B65D 33/02* (2006.01)
*B65D 30/18* (2006.01)
(Continued)

(52) U.S. Cl.
CPC ..... *B65D 31/08* (2013.01); *B65D 33/02* (2013.01); *B65D 33/2508* (2013.01); *B65D 75/008* (2013.01)

(58) Field of Classification Search
CPC ..... B65D 78/08; B65D 31/10; B31B 2219/23
(Continued)

(56) References Cited

U.S. PATENT DOCUMENTS 3,738,565 A 6/1973 Ackley et al.
4,353,497 A 10/1982 Bustin
(Continued)

FOREIGN PATENT DOCUMENTS

EP 0 626 319 A1 11/1994
FR 2 759 981 A1 8/1998

OTHER PUBLICATIONS

Invitation to Pay Additional Fees and, Where Applicable, Protest Fee mailed Jun. 5, 2015, in corresponding International Patent Application No. PCT/US2015/019878.
(Continued)

*Primary Examiner* — Christopher Demeree

(57) ABSTRACT

A storage bag shifts between a flat configuration with first and second sidewalls positioned adjacent to each other, and a stand-up configuration with the sidewalls separated. In the stand-up configuration, the bag has a substantially flat base (i) formed by the bottom portion of the first and second sidewalls, and (ii) outlined by at least one of the shift regions of the sidewalls. An angle α is defined between each of (i) the first shift region of the first sidewall and an adjacent edge of the bag and (ii) the first shift region of the second sidewall and an adjacent edge of the bag, and (b) a differing angle β is defined between each of (i) the second shift region of the first sidewall and a bottom edge of the bag and (ii) the second shift region of the second sidewall and the bottom edge of the bag.

40 Claims, 8 Drawing Sheets

(51) Int. Cl.
*B65D 33/25* (2006.01)
*B65D 75/00* (2006.01)

(58) Field of Classification Search
USPC ..... 383/123, 121, 104, 120; 493/218
See application file for complete search history.

(56) References Cited

U.S. PATENT DOCUMENTS

| | | | |
|---|---|---|---|
| 4,837,849 | A | 6/1989 | Erickson et al. |
| 4,993,844 | A | 2/1991 | Robinson et al. |
| 5,070,584 | A | 12/1991 | Dais et al. |
| 5,375,930 | A | 12/1994 | Tani |
| 5,547,284 | A | 8/1996 | Imer |
| 5,664,299 | A | 9/1997 | Porchia et al. |
| 5,836,056 | A | 11/1998 | Porchia et al. |
| 6,030,652 | A | 2/2000 | Hanus |
| 6,334,710 | B1 | 1/2002 | Kuge et al. |
| 6,345,911 | B1 | 2/2002 | Young et al. |
| 6,409,386 | B1 | 6/2002 | Trani et al. |
| 6,533,456 | B1 | 3/2003 | Buchman |
| 6,746,388 | B2 | 6/2004 | Edwards et al. |
| 6,874,938 | B2 | 4/2005 | Price et al. |
| 6,957,915 | B2 | 10/2005 | Tankersley |
| 7,052,181 | B2 | 5/2006 | Smith et al. |
| 7,784,160 | B2 | 8/2010 | Dais et al. |
| 7,886,412 | B2 | 2/2011 | Dais et al. |
| 7,946,766 | B2 | 5/2011 | Dais et al. |
| 8,061,898 | B2 | 11/2011 | Pawloski et al. |
| 8,182,152 | B2 | 5/2012 | Plunkett et al. |
| 8,251,881 | B2 | 8/2012 | Chertkow et al. |
| 8,251,971 | B2 | 8/2012 | Graf et al. |
| 8,267,580 | B2 | 9/2012 | Schneider |
| 8,523,440 | B2 | 9/2013 | Walker et al. |
| 8,616,768 | B2 | 12/2013 | Inagaki et al. |
| 9,296,171 | B2 | 3/2016 | Bierschenk et al. |
| 2002/0168120 | A1 | 11/2002 | Wessling et al. |
| 2004/0161174 | A1 | 8/2004 | Bartel et al. |
| 2004/0184682 | A1 | 9/2004 | Lovold |
| 2005/0244084 | A1 | 11/2005 | Tilman et al. |
| 2006/0140514 | A1 | 6/2006 | Dierl et al. |
| 2007/0127851 | A1 | 6/2007 | Tilman et al. |
| 2007/0237433 | A1 | 10/2007 | Plunkett et al. |
| 2009/0180718 | A1 | 7/2009 | Walker et al. |
| 2009/0232424 | A1 | 9/2009 | Bierschenk et al. |
| 2009/0324141 | A1 | 12/2009 | Dais et al. |
| 2010/0061665 | A1 | 3/2010 | Inagaki et al. |
| 2010/0272377 | A1 | 10/2010 | Herbig et al. |
| 2011/0019942 | A1 | 1/2011 | Piraneo |
| 2013/0174386 | A1 | 7/2013 | Koenigkramer |
| 2013/0177262 | A1 | 7/2013 | Anzini et al. |
| 2014/0245698 | A1 | 9/2014 | Steele |

OTHER PUBLICATIONS

Notification of and International Search Report and Written Opinion mailed Aug. 7, 2015, in corresponding International Patent Application No. PCT/US2015/019878.

Notification of and International Search Report and Written Opinion mailed Jun. 7, 2016, in corresponding International Patent Application No. PCT/US2015/047937.

STAND-UP PLASTIC STORAGE BAG

CLAIM OF PRIORITY

This application is a continuation-in-part of U.S. patent application Ser. No. 14/204,075, filed Mar. 11, 2014, now U.S. Pat. No. 9,505,525, issued Nov. 29, 2016 each of which is incorporated herein by reference in its entirety.

BACKGROUND

Field of the Invention

Our invention relates to a storage bag. More specifically, our invention relates to a plastic storage bag that can be shifted between a flat configuration and a stand-up configuration wherein the bag can be easily filled.

Related Art

Storage bags made from flexible plastic materials are well known. Such plastic storage bags are offered in a variety of sizes and can be used to contain a variety of items, including food, utensils, clothing, tools, etc. These storage bags often include a zipper-like closure mechanism to releasably seal the interior of the bag. Different types of plastic storage bags with closure mechanisms are sold by the assignee of the present application under the ZIPLOC® trademark.

It is desirable to configure a plastic storage bag such that a user can set the bag in an opened position with the bag standing upright and without the user having to hold onto the bag. That is, it is desirable for a plastic storage bag to stand upright, with its closure mechanism unsealed, without the user grasping the bag. In such an upright and opened position, the user's hands are free to fill the bag with items. At other times, however, it is desirable for the plastic storage bag to lie as flat as possible. For example, when the bag is not being used, a flat bag may be more compactly stored.

In order to provide a plastic storage bag that can stand upright without the user holding onto the bag, a pleat or gusset is sometimes added to the bottom of the bag. By "pleat" or "gusset" we mean additional material provided between other portions of the bag, for example, a fold formed by doubling back the material forming the bag on itself. An example of such a pleat/gusset arrangement in a bag can be seen in U.S. Pat. No. 3,738,565. In addition to a pleat, a storage bag may be made thicker throughout its sides and bottom to more firmly support itself in an upright position. Both a pleat and a thicker bag, however, require the use of additional material to form the bag, thereby increasing the costs associated with manufacturing the bag. Moreover, a pleat and additional material reduce the ability of the bag to be made flat, for example, when not being used and being stored.

SUMMARY OF THE INVENTION

In one aspect, our invention is directed a storage bag includes a first sidewall with at least one shift region that extends from near a corner of the first sidewall. A second sidewall is directly connected to the first sidewall along three sides of the bag to form an interior of the bag with an opening thereto, with the second sidewall including at least one shift region that extends from near a corner of the second sidewall. The bag is shiftable about the at least one shift region of the first sidewall and shiftable about the at least one shift region of the second sidewall such that the bag can be shifted between (i) a flat configuration with the first and second sidewalls positioned adjacent to each other, and (ii) a stand-up configuration with the first and second sidewalls separated from each other. In the stand-up configuration, a substantially flat base is formed for the bag.

In a further aspect, our invention is directed to a storage bag that includes a first sidewall including (i) a first shift region that extends from near a first corner of the first sidewall, (ii) a second shift region that extends from near the first corner of the first sidewall, (iii) a third shift region that extends from near a second corner of the first sidewall, and (iv) a fourth shift region that extends from near the second corner of the first sidewall. The storage bag also includes a second sidewall connected to the first sidewall so as to form an interior of the bag with an opening thereto, the second sidewall including (i) a first shift region that extends from near a first corner of the second sidewall, (ii) a second shift region that extends from near the first corner of the second sidewall, (iii) a third shift region that extends from near a second corner of the second sidewall, and (iv) a fourth shift region that extends from near the second corner of the second sidewall. The bag can be shifted between (i) a flat configuration with the first and second sidewalls positioned adjacent to each other and (ii) a stand-up configuration with the first and second sidewalls separated from each other. In the stand-up configuration, the bag is shifted about the first, second, third, and fourth shift regions of the first sidewall and about the first, second, third, and fourth shift regions of the second sidewall such that a substantially flat base is formed for the bag.

In another aspect, our invention is directed to a storage bag that includes a first sidewall including (i) shift regions that extend from near a first corner of the first sidewall and (ii) shift regions that extend from near a second corner of the first sidewall. The bag also includes a second sidewall directly connected to the first sidewall along three sides of the bag to form an interior of the bag with an opening thereto, the second sidewall including (i) shift regions that extend from near a first corner of the second sidewall and (ii) shift regions that extend from near a second corner of the second sidewall. The bag is shifted about the shift regions of the first sidewall and shifted about the shift regions of the second sidewall such that the bag can be shifted between (i) a flat configuration with the first and second sidewalls positioned adjacent to each other, and (ii) a stand-up configuration with the first and second sidewalls separated from each other. In the stand-up configuration, a substantially flat base is formed for the bag.

In another aspect, our invention is directed to a storage bag that includes a first sidewall and a second sidewall connected to the first sidewall so as to form an interior of the bag with an opening thereto. The first and second sidewalls each include (i) a first shift region that extends from near a first corner of the bag, (ii) a second shift region that extends from near the first corner of the bag, (iii) a third shift region that extends from near a second corner of the bag, and (iv) a fourth shift region that extends from near the second corner of the bag. When $\alpha$ is an angle between the first and third shift regions of the first and second sidewalls and adjacent to edges of the bag, and when $\beta$ is an angle between the second and fourth shift regions of the first and second sidewalls and a bottom edge of the bag, then $\alpha$ and $\beta$ are generally defined by the equation $\beta=-4/7\alpha+45$.

In yet another aspect, our invention is directed to a storage bag comprising a first sidewall that includes (i) shift arrangements that extend from near a first corner of the first sidewall and (ii) shift arrangements that extend from near a second corner of the first sidewall. A second sidewall is directly connected to the first sidewall along three sides of the bag to form an interior of the bag with an opening thereto. The second sidewall includes (i) shift arrangements that extend from near a first corner of the second sidewall and (ii) shift arrangements that extend from near a second corner of the second sidewall. The bag is shiftable about the shift arrangements of the first sidewall and shiftable about the shift arrangements of the second sidewall such that the bag can be shifted between (i) a flat configuration with the first and second sidewalls positioned adjacent to each other, and (ii) a stand-up configuration with the first and second sidewalls separated from each other. In the stand-up configuration, a substantially flat base is formed for the bag.

DETAILED DESCRIPTION OF THE INVENTION

Figure 1A:
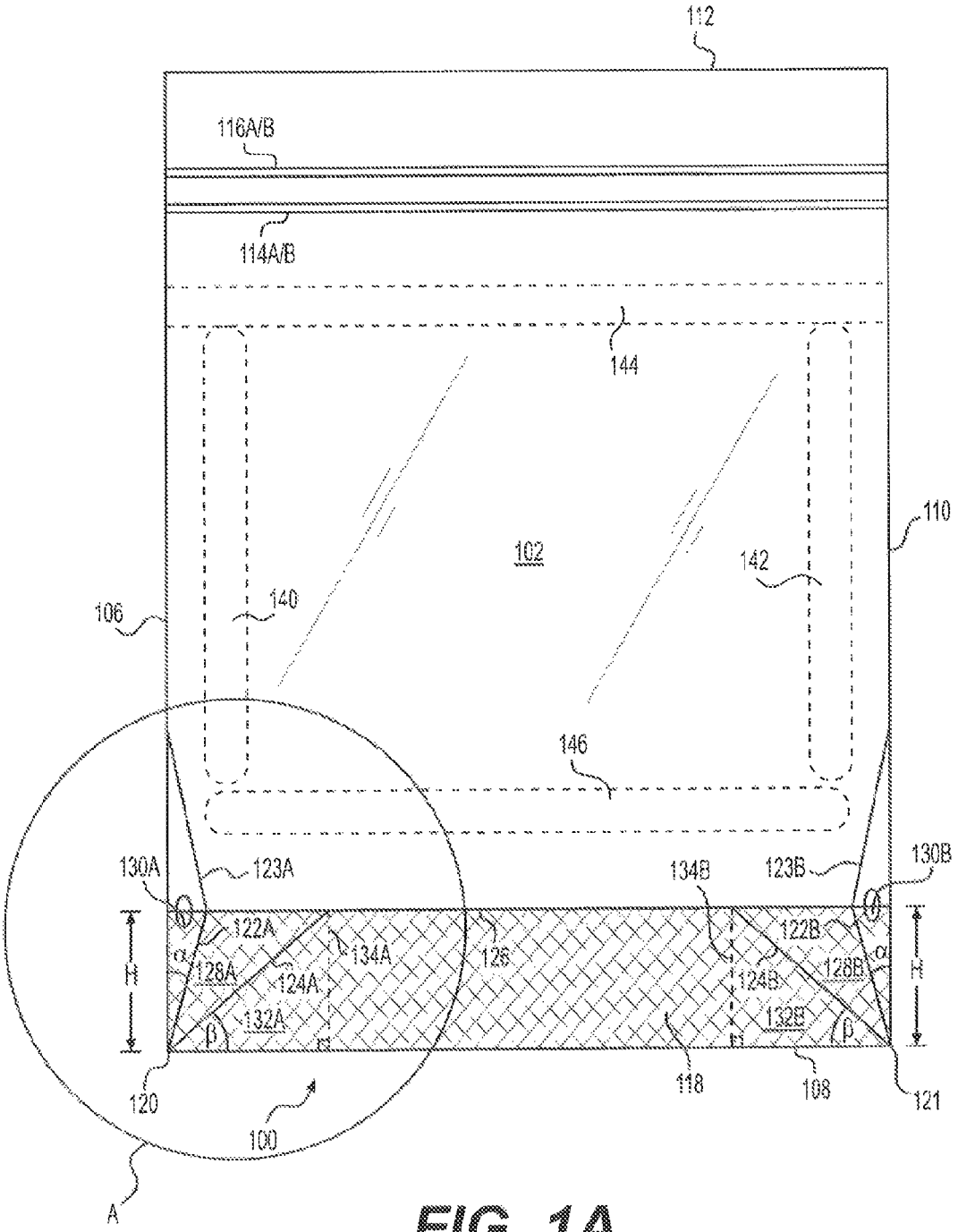
FIG. 1A is a side view of a bag according to our invention in a flat configuration.

Our invention relates to a plastic storage bag that includes features for shifting the bag between a flat configuration and a stand-up configuration. In the stand-up configuration, the bag stands on a substantially flat base without being grasped by a user such that the bag can easily be filled.

As will be apparent from the description herein, the terms "bag" and "storage bag" encompass a broad range of structures designed to contain items. Such bag structures might also be termed pouches, envelopes, packets, and the like. In general, the terms "bag" and "storage bag," as used herein, simply mean a somewhat flexible container with an opening, such that the bag is capable of carrying any number of items. The storage bags may be tailored for particular uses, for example, the bags may be used to store food in a refrigerator in some embodiments, or the bags may be used to store food in a freezer in other embodiments.

FIGS. 1A, 1B, and 2-4 are views of a storage bag 100 according to embodiments of our invention. The bag 100 includes a first sidewall 102 and a second sidewall 104 that are connected along side edges 106 and 110 and along a bottom edge 108. An opening 112 is formed at the top of the bag 100 through which items may be placed into the interior of the bag 100. Notably, the bag 100 does not include a pleat or gusset at the bottom portion 118 between the first and second sidewalls 102 and 104. That is, the first and second sidewalls 102 and 104 are directly connected to each other along the bottom edge 108 of the bag 100 without any sort of folding or expandable structure provided between the sidewalls 102 and 104. The first and second sidewalls 102 and 104 are also directly connected along side edges 106 and 110 without any pleat or gusset connecting the two sidewalls 102 and 104.

The opening 112 may be sealed by the interlocking closure structures 114A, 114B, 116A, and 116B. Interlocking closure structures for plastic storage bags are well known in the art, and examples of different shapes and configurations of interlocking members that can be used with our storage bag 100 can be seen in U.S. Pat. Nos. 5,070,584; 7,784,160; 7,886,412; 7,946,766; and 8,061,898, and in U.S. Patent Application Publication No. 2009/0324141, the disclosures of which are incorporated by reference herein in their entirety. As an alternative to the closure structures 114A, 114B, 116A, and 116B, in other embodiments, a slider-type closure structure could be used to seal the opening 112 of the bag 100 along the top edge of the first and second sidewalls 102 and 104. Examples of slider-type closure structures can be seen in U.S. Pat. Nos. 5,664,299; 5,836,056; and 7,052,181, the disclosures of which are incorporated by reference herein in their entirety.

Illustrative plastic materials that can be used to form the bag 100 include, for example, polypropylene (PP), polyethylene (PE), metallocene-polyethylene (mPE), low density polyethylene (LDPE), linear low density polyethylene (LLDPE), ultra low density polyethylene (ULDPE), biaxially-oriented polyethylene terephthalate (BPET), high density polyethylene (HDPE), polyethylene terephthalate (PET), among other polyolefin plastomers and combinations and blends thereof. Still other materials that may be used include styrenic block copolymers, polyolefin blends, elastomeric alloys, thermoplastic polyurethanes, thermoplastic copolyesters, thermoplastic polyamides, polymers and copolymers of polyvinyl chloride (PVC), polyvinylidene chloride (PVDC), saran polymers, ethylene/vinyl acetate copolymers, cellulose acetates, polyethylene terephthalate (PET), ionomer, polystyrene, polycarbonates, styrene acryloacrylonitrile, aromatic polyesters, linear polyesters, and thermoplastic polyvinyl alcohols. Those skilled in the art will recognize that a wide variety of other materials may also be used to form the storage bag 100. Those skilled in the art will also recognize that by using the plastic materials described above, the storage bag 100 can be made in a range of colors and transparencies.

A variety of manufacturing techniques may be used to form the plastic storage bag 100. As one specific example, the sidewalls 102 and 104 of the bag 100 can be extruded together as one sheet, with a portion of the first sidewall 102 and a portion of the second sidewall 104 being joined together to form the bag structure using, for example, thermoplastic welding techniques. As another example, the first and second sidewalls 102 and 104 can be formed as separate structures that are joined together along the three edges 106, 108, and 110. Along these lines, when referring herein to the sidewalls 102 and 104 as being "connected" together, the sidewalls may be integrally formed, or, alternatively, the sidewalls 102 and 104 may be separate structures that have been joined together at the connection. The formation of specific additional features of the bag 100 will be described below.

Figure 1B:
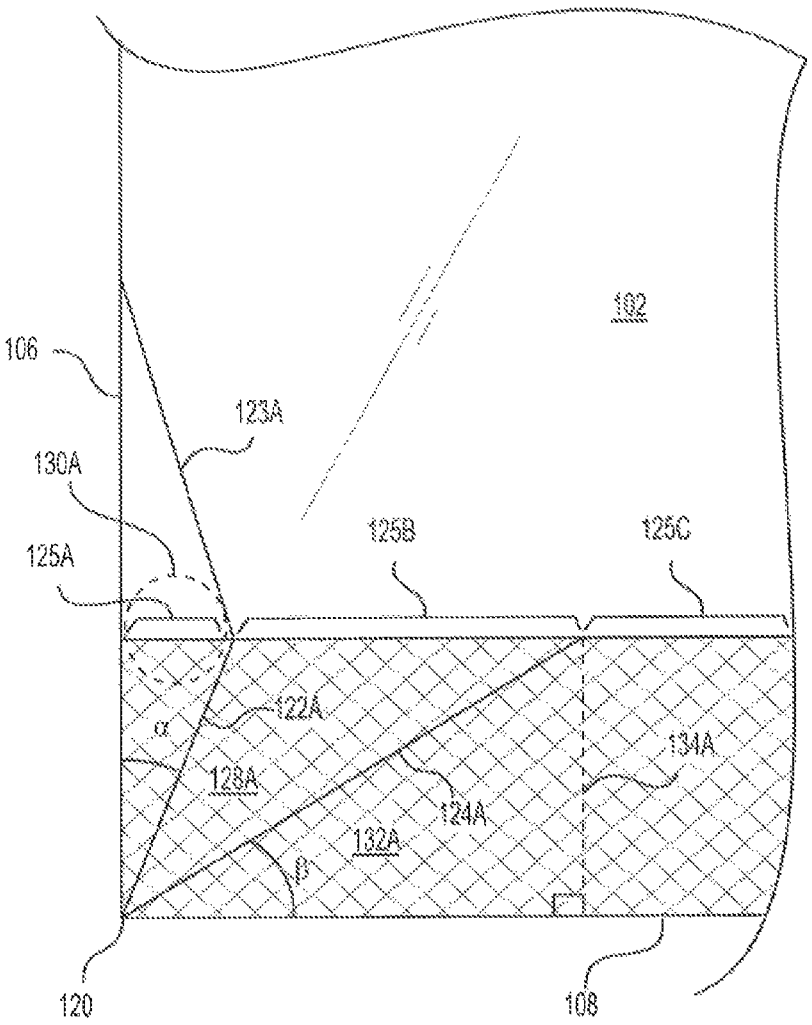
FIG. 1B is a detailed view of the section A of the bag shown in FIG. 1A.
Figure 2:
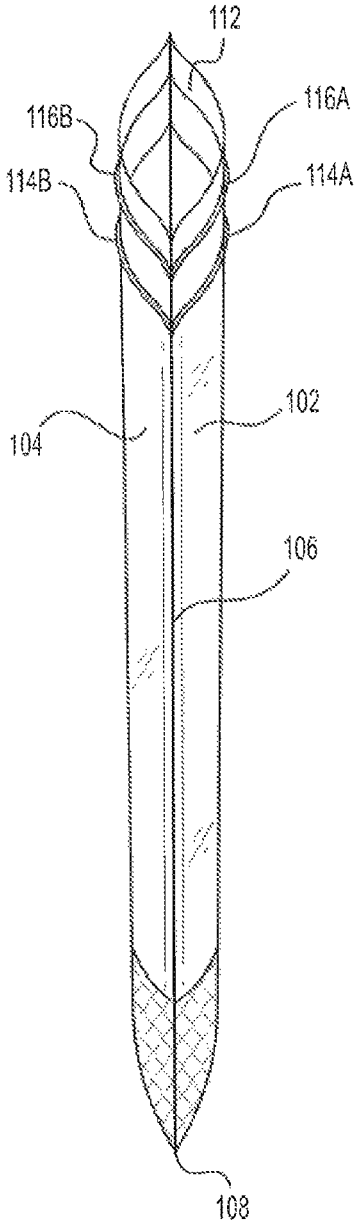
FIG. 2 is an end view of a bag according to our invention in the flat configuration.
Figure 3:
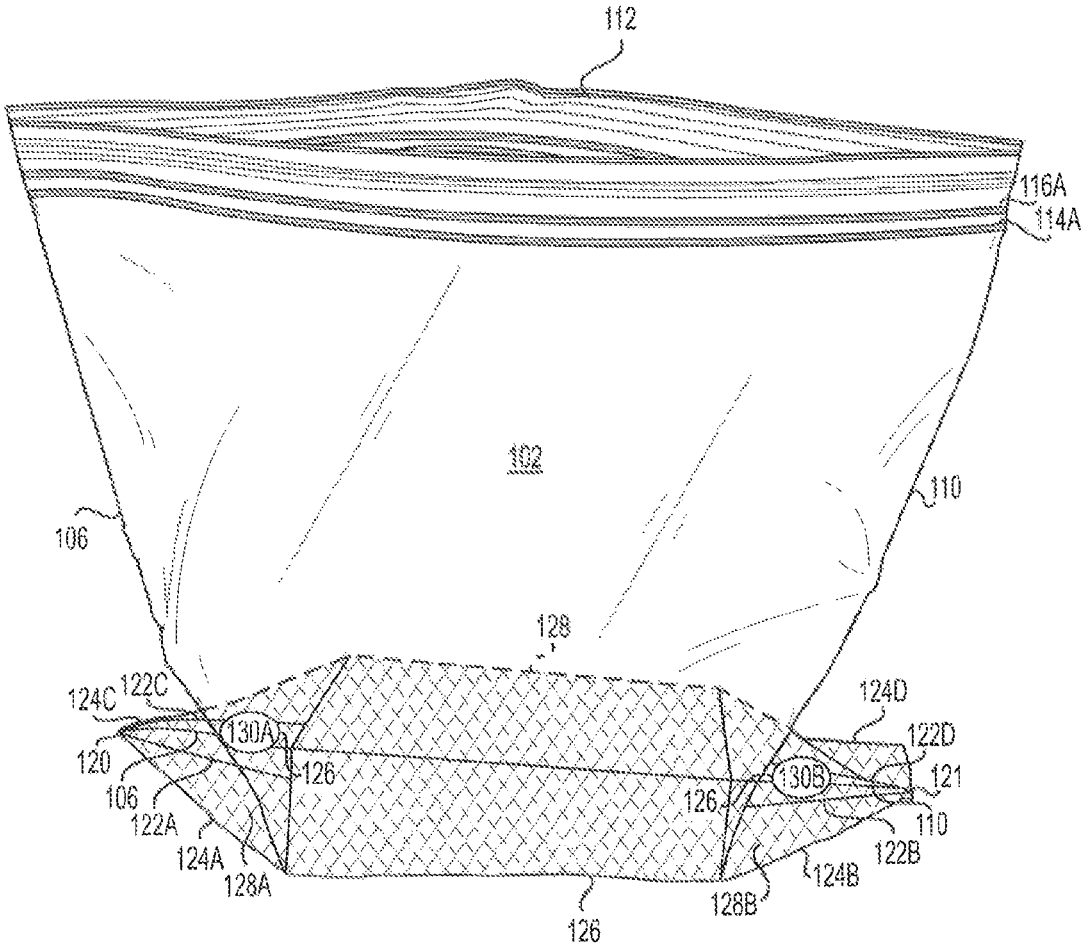
FIG. 3 is a perspective view of the side of a bag according to our invention in a stand-up configuration.
Figure 4:
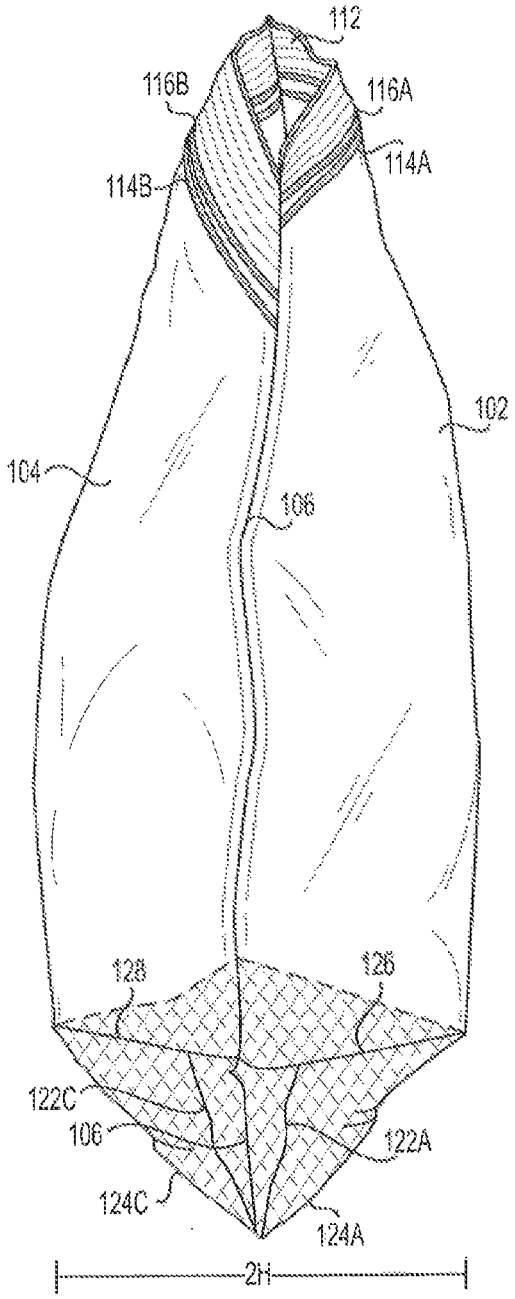
FIG. 4 is a perspective view of the side of a bag according to our invention in the stand-up configuration.

The storage bag 100 according to our invention can be shifted between a flat configuration, as shown in FIGS. 1A, 1B, and 2, and a stand-up configuration, as shown in FIGS. 3 and 4. The bag 100 maintains the stand-up position even though it does not include a pleat or gusset adjacent to its bottom edge 126. Instead, the bag 100 is made to stand upright through unique configurations at the bottom portions 118 of the sidewalls 102 and 104, which will now be described.

As shown in FIGS. 1A and 3, a plurality of shift regions 122A, 122B, 123A, 123B, 124A, 124B, 124C, 124D, 126, and 128 is formed in the bottom portion 118 of the first sidewall 102. FIG. 1B shows the details of the region A in FIG. 1A, including the additional shift regions 125A, 125B, and 125C. The shift regions are configured to allow the bag to be easily shifted between flat and stand-up configurations, as will be described in detail below. In some embodiments, the shift regions 122A, 122B, 123A, 123B, 124A, 124B, 124C, 124D, 125A, 125B, 125C, 126, and 128 are slight indentations, scores, or crimps formed in the sidewalls 102 and 104 of the bag 100 that are made to a depth such that the bag 100 can easily shift about the regions. However, the shift regions 122A, 122B, 123A, 123B, 124A, 124B, 124C, 124D, 125A, 125B, 125C, 126, and 128 are not made to a depth that substantially weakens the integrity of the bag 100. Those skilled in the art will recognize that a variety of techniques can be used to form the shift regions 122A, 122B, 123A, 123B, 124A, 124B, 124C, 124D, 125A, 125B, 125C, 126, and 128, such as cutting the bag 100 with a mechanical structure or, as another example, by using ultrasonic cutting. As yet another example, the shift regions 122A, 122B, 123A, 123B, 124A, 124B, 124C, 124D, 125A, 125B, 125C, 126, and 128 can be formed by deforming the sidewalls 102 and 104 of the storage bag 100 by squeezing portions of the sidewalls 102 and 104 so as to permanently deform the portions in the shapes of the shift regions.

With the shift regions 122A, 122B, 123A, 123B, 124A, 124B, 124C, 124D, 125A, 125B, 125C, 126, and 128, the bag 100 is shiftable between a flat configuration, as shown in FIGS. 1A, 1B, and 2, and a stand-up configuration, as shown in FIGS. 3 and 4. In the flat configuration, the first and second sidewalls 102 and 104 are positioned adjacent to each other. In the stand-up configuration, the first and second sidewalls 102 and 104 are separated from each other. To separate the first and second sidewalls 102 and 104, the bottom portion 118 of the bag is moved about the shift regions 122A, 122B, 123A, 123B, 124A, 124B, 124C, 124D, 125A, 125B, 125C, 126, and 128 such that the bottom portion 118 forms a substantially flat base for the upright bag 100. By being shifted in this manner, the ends of the bottom portion 118 that are adjacent to the corners 120 and 121 extend outward in a triangular-shaped configuration. The bottom portion 118 of the bag 100 is thereby outlined by the shift regions 124A, 124B, 124C, 124D, 126, and 128. When shifting from the flat configuration to the stand-up configuration, the bag 100 is also moved about shift regions 122A and 122B, such that the portions 130A and 130B of the first sidewall 102 are shifted over other portions 128A and 128B of the first sidewall 102. Shifting to the stand-up configuration is facilitated by grasping the bag 100 at the portions 130A and 130B, which, in effect, act as hinges that naturally effect shifting of the bag 100 to the stand-up configuration.

In the embodiment shown in FIGS. 1A to 4, the shift regions are provided on both of the bottom corners of both sidewalls 102 and 104 of the bag 100. Specifically, a plurality of shift regions 124C, 124D, and 128 is provided on the second sidewall 104 corresponding to the shift regions 124A, 124B, and 126 that are provided on the first sidewall 104, as can be seen in FIGS. 3 and 4. Note that by "corresponding," we mean that the shift regions are in the same relative positions on the first and second sidewalls 102 and 104. In other embodiments, however, fewer shift regions may be provided. For example, the shift regions may only be provided in one corner of one of the sidewalls 102 and 104. In still other embodiments, shift regions may be provided on the two bottom corners of one of the sidewalls 102 and 104, but not provided on the other of the sidewalls 102 and 104. In yet other embodiments, the shift regions may be provided on the bottom corner of one of the sidewalls 102 and 104 and other shift regions may be provided on the bottom corner on the other side of the other sidewall 102 or 104, such that the shift regions on one side of the bag 100 do not correspond to shift regions on the other side of the bag 100.

Similarly, the bag 100 may only include some, but not all, of the depicted shift regions 122A, 122B, 123A, 123B, 124A, 124B, 124C, 124D, 125A, 125B, 125C, 126, and 128. For example, in one embodiment, the bag 100 might include the shift regions 122A, 122B, 124A, and 124B, but not include any of the other depicted shift regions 123A, 123B, 124C, 124D, 125A, 125B, 125C, 126, and 128. In such an embodiment, the shift regions 122A, 122B, 124A, and 124B function by themselves to shift the bag 100 from the flat configuration to the stand-up configuration. Also, in the depicted embodiments, the shift regions 122A, 122B, 123A, 123B, 124A, 124B, 124C, 124D, 125A, 125B, 125C, 126, and 128 are shown to extend in continuous lines. In other embodiments, however, the shift regions 122A, 122B, 123A, 123B, 124A, 124B, 124C, 124D, 125A, 125B, 125C, 126, and 128 can be discontinuous. For example, any one of the shift regions can be formed as a plurality of distinct line segments, dots, etc. As will be appreciated by those skilled in the art, the number and continuity of the shift regions provided to a bag according to our invention can be adjusted in order to make the shifting of the bag more or less easy, or the number and continuity of the shift regions can be adjusted based on other factors such as aesthetics and cost of manufacturing of the bag. Along these lines, in some embodiments, the bag may only be provided with one of the shift regions 122A, 122B, 123A, 123B, 124A, 124B, 124C, 124D, 125A, 125B, 125C, 126, and 128.

As can be seen in FIGS. 1A and 1B, there are two angles α and β formed by the shift regions 122A, 122B, 124A, 124B, 124C, 124D, 126, and 128 relative to the side edges 106 and 110, bottom edge 108. Further, with the reference lines 134A and 134B, areas 128A, 128B, 132A, and 132B are defined. Note that reference lines 134A and 134B are provided in FIGS. 1A and 1B for purposes of understanding our invention, but are not actually a structure in the bag 100. As is apparent from the figures, the size of angles α and β determines the relative sizes of the areas 128A, 128B, 132A, and 132B. Generally speaking, we have found that, to facilitate the shifting movement from the flat configuration to the stand-up configuration, the areas 128A and 128B should be approximately equal to the areas 132A and 132B. Further, we have found that shifting is greatly facilitated when the angles α and β satisfy the following Equation (1):

$$\beta = -\frac{4}{7}\alpha + 45 \tag{1}$$

When angles α and β are generally defined by the relation of Equation (1), the bag 100 can be easily shifted from the flat configuration to the stand-up configuration. Note, however, that Equation (1) does not have to be exactly satisfied, but rather, both α and β can vary slightly from the relation while still allowing for the bag 100 to be easily moved from the flat configuration to the stand-up configuration. For example, given a specific angle α, then angle β may vary by less than about ±2 degrees from the value for angle β calculated from Equation (1). Given a specific angle β, then angle α may vary less than about ±4 degrees from the value for angle α calculated from Equation (1). For example, in specific embodiments, angle α is about 14 degrees to about 16 degrees and angle β is about 37 degrees to about 39 degrees. It should again be noted, however, that the bag 100 is not necessarily limited to any particular angle α and angle β.

The horizontal shift regions 126 and 128 extend a height H above the bottom edge 108 of the bag 100. This height H will, in effect, determine the width of the flat base of the bag 100 when the bag 100 is in the stand-up configuration. That is, as shown in FIG. 4, the width of the bottom of the bag 100 is about 2 H at a center region of the bag. In embodiments of our invention, the height H is about 1 inch to about 3.5 inches, more specifically, about 1.5 inches to about 3 inches, and still more specifically, about 2 inches to about 2.5 inches. It follows that the width of the base of the bag is about twice these heights, i.e., about 2 inches to about 7 inches, more particularly, about 3 inches to about 6 inches, and still more particularly, about 4 inches to about 5 inches. In a specific embodiment, the height H is about 2 inches, and, thus, the width of the base of the bag is about 4 inches. Generally speaking, with such ranges, storage bags of standard sizes, such as those for storing food, can be made to stand upright.

With the configuration of the bag 100 shown in FIGS. 1A to 4, the bag 100 may be made to stand upright without any additional structural features. For example, unlike other bags known in the art, the bag 100 does not need to include a pleat or gusset between the bottom portions of the first and second sidewalls 102 and 104. In addition, to not require a pleat or gusset, the sidewalls 102 and 104 of the bag 100 can be made with a relatively uniform thickness. Along these lines, in some embodiments, the sidewalls 102 and 104 may have a thickness of only about 1.6 mils to about 2.6 mils. As one of ordinary skill in the art will appreciate, thickness of about 1.6 mils is substantially thinner than the thickness of many types of stand-up plastic storage bags.

While the bag 100 will remain in the stand-up configuration when provided with uniformly thick sidewalls 102 and 104, in other embodiments, specific portions of the bag 100 are made thicker in order to further facilitate the stand-up configuration. In one example, regions of the bottom portions 108 of the sidewalls 102 and 104 of the bag 100 are made thicker than the rest of the bag 100. Specifically, the bottom portions 108 are about twice as thick as the other portions of the sidewalls 102 and 104. In other embodiments, regions of the bottom portions 108 are made about one mil thicker than the other portions of the sidewalls 102 and 104. When an extruding technique is used to manufacture the bag 100, the bottom portions 108 can be made thicker by adjusting the amount of material used to form the bottom portions 108 in comparison with the other portions, e.g., by adjusting the extruding process such that the bottom portions 108 are about 1 mil thicker, while the other portions of the side walls 102 and 104 are reduced by about 0.1 mil of thickness.

In some embodiments, the bottom portions 108 of the first and second sidewalls 102 and 104 can be made visually distinct from the other portions of the first and second sidewalls 102 and 104. For example, a visually distinct texture could be formed in the bottom portions 108 between the horizontal shift regions 126 and 128 of the first and second sidewalls 102 and 104. Such a texture may aid the user in identifying the bottom portions 108 that are to be shifted. Further, the texture may increase the friction of the base when the bag 100 is in the stand-up configuration, thereby further stabilizing the bag 100.

In order to further facilitate the stand-up configuration of the bag 100, other portions of the sidewalls 102 and 104 above the bottom portions 108 can be made stiffer. Examples of such stiffer portions are the areas labeled as 140, 142, 144, and 146 on the first sidewall 102 in FIG. 1A. Although not shown, corresponding stiffer areas can be formed on the second sidewall 104. The stiffer portions 140, 142, 144, and 146 provide structural support to the sidewalls 102 and 104 that helps to maintain the bag upright in the stand-up configuration. While the stiffer areas 140, 142, and 146 extend within the sidewall 102, the stiffer area 144 extends from the edge 106 to the edge 110 of the sidewall 102. By extending the full length of the sidewall 102 and being positioned adjacent to the opening 112 of the bag 100, the stiffer area 144, along with a corresponding stiffer area on the second sidewall 104, helps to maintain the opening 112 in an open position when the bag 100 is in the stand-up configuration and the closure structures 114A, 114B, 116A, and 116B are not sealed. At the same time, the vertical stiffer areas 140 and 142, and the corresponding stiffer areas on the sidewall 104 help to push out the sides of the bag in the stand-up configuration. The bag 100, therefore, can be maintained in an upright position so that it can be easily filled by a user.

The stiffer areas 140, 142, 144, and 146 can be formed by extruding the sidewalls 102 and 104 of the bag in a manner such that the areas 140, 142, 144, and 146 on the first sidewall 102, and the corresponding portions on the second sidewall 104, are made thicker than the other portions of the sidewalls 102 and 104. Alternatively, the stiffer areas 140, 142, 144, and 146 can be formed by applying additional material onto the sidewalls 102 and 104.

Figure 5:
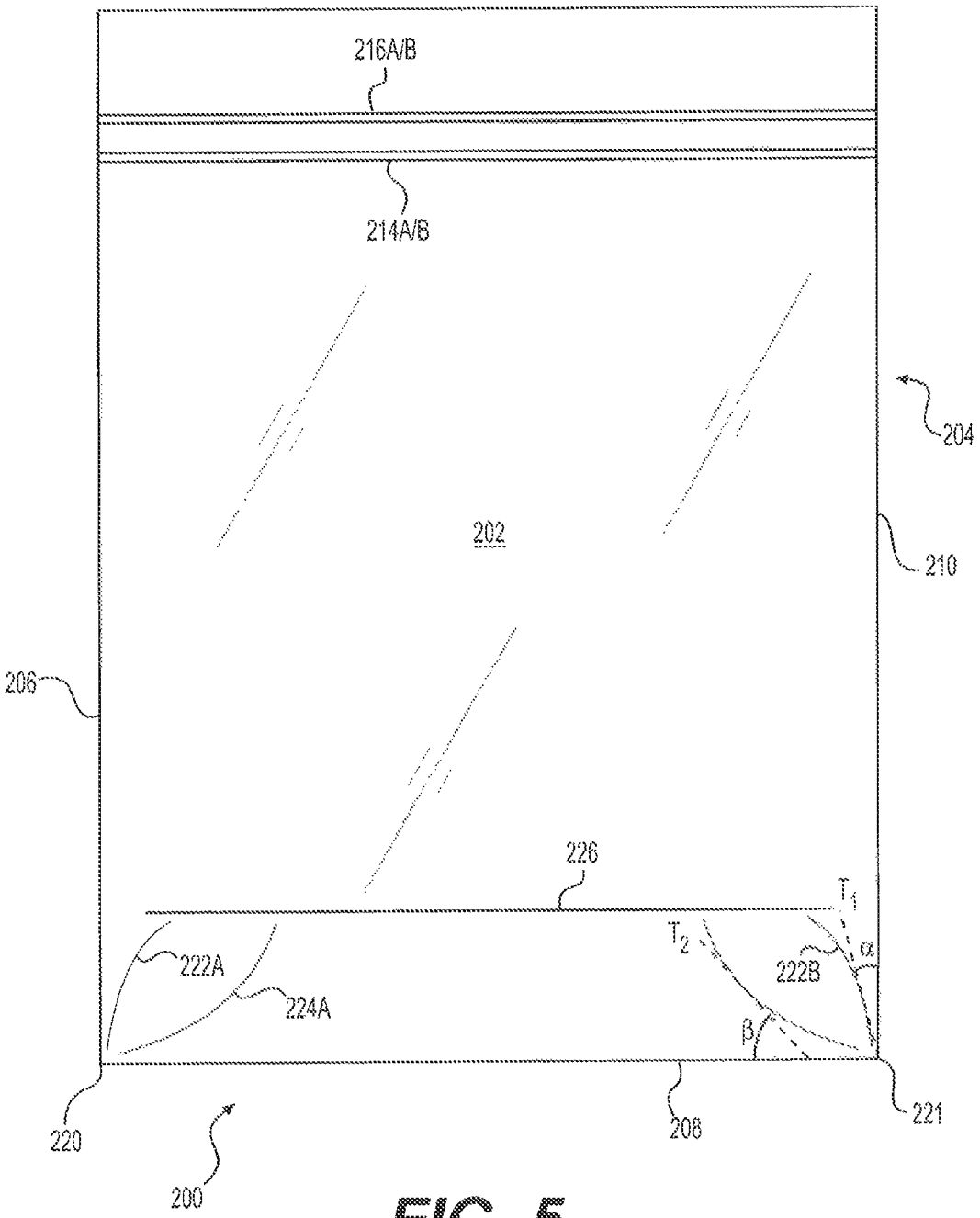
FIG. 5 is a side view of a bag according to another embodiment of our invention.
Figure 6A:
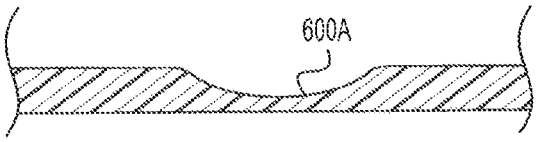
FIGS. 6A-6G are cross-sectional views of portions of bags according to embodiments of our invention.
Figure 6B:
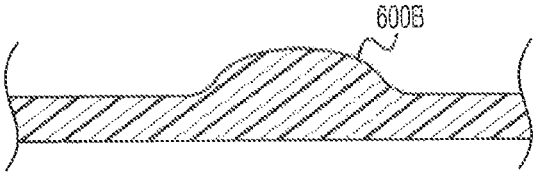
Figure 6C:
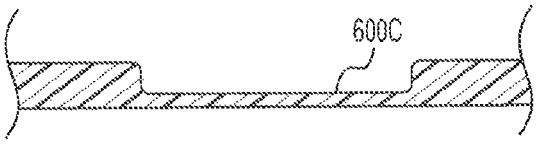
Figure 6D:
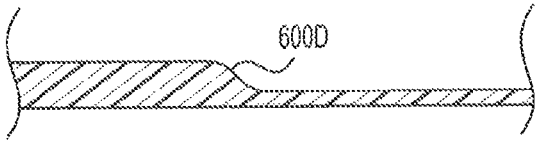
Figure 6E:
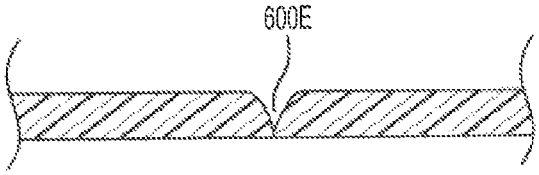
Figure 6F:
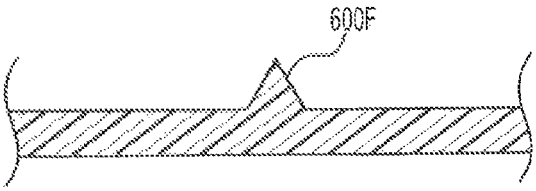
Figure 6G:
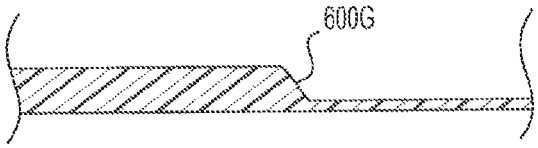

FIG. 5 is a side view of a bag 200 according to another embodiment of our invention. The bag 200 includes some of the features that are provided in the embodiments described above, including sidewalls 202 and 204 and closure structures 224A, 224B, 226A, and 226B. In the bag 200, however, the shift regions 222A, 222B, 224A, and 224B do not extend all the way to corners 220 and 221. Instead, the shift regions 222A, 222B, 224A, and 224B extend from positions close to, but not directly adjacent to, the corners 220 and 221. In this regard, the shift regions in embodiments of our invention may extend from positions "near" the corners, in that the shift regions extend from positions directly adjacent to the corners, as shown in the bag 100 in FIG. 1A, or from other positions "near" the corners, in that the shift regions extend from positions that are close to the corners, as shown in FIG. 5 with respect to bag 200.

The shift regions 222A, 222B, 224A, and 224B of bag 500 are not straight, but instead, have a curved shape. The bag 200 is shiftable between a flat configuration and a stand-up configuration by being shifted about the curved shift regions 222A, 222B, 224A, 224B, and 226 in a manner similar to the way that the bag 100 shifts between configurations, as described above. With the curved shift regions 222B and 224B, the angle α is measured between the side 210 and a line T1 that is tangent to a point in the middle portion of the shift region 222B, and the angle β is measured between the bottom 208 and a line T2 that is tangent to a point in the middle portion of the shift region 224B. Although not shown, similar angles α and β can be measured between lines tangent to the shift regions 222A, 224A, the side edge 206, and the bottom edge 208. The angles α and β may be in the relation of Equation (1), as described above.

In the embodiments described above, a bag according to our invention is described as being provided with shift regions that are formed as indentations in the bags. In other embodiments, however, the locations about which the bag is shifted between the flat and stand-up configurations could be formed in a different manner, such as by providing additional polymeric material to the sides of the bag. For example, polyethylene may be provided on the sides of the bag at the same positions as the above-described shift regions on the bag. Those skilled in the art will appreciate the variety of techniques that could be used to apply such additional material, for example, nozzles that turn on and off to rapidly deposit the material in the pattern of the shift regions. In other embodiments, the locations about which the bag can be shifted are provided as regions of varying thickness, elevation, etc., in the sides of the bag. In this regard, FIGS. 6A-6G are cross-sectional views of portions of bags according to embodiments of our invention, with the cross sections including different shift regions 600A to 600G. Any of the shift regions 600A to 600G may be provided at locations about which the bag can be shifted between the flat and stand-up configurations, such as the positions of the shift regions in the embodiments described above. Thus, the shift regions 600A to 600G provide for a bottom when the bag is in a stand-up configuration, and the bag need not include a pleat or gusset formed between the sidewalls at the bottom of the bag.

A bag according to our invention is highly functional inasmuch as it can be made to stand upright without being held by a user. The bag can thereby be set on a surface, and easily filled by the user. This stand-up configuration is achieved without the use of a pleat, gusset, or other additional structure at the bottom portion of the bag. Thus, the bag can be made to lay substantially flat when not in use, and thereby be compactly stored. Further, by not including an additional structure at the bottom portion, the bag can be made from substantially less material than other stand-up bags known in the art. Those skilled in the art will recognize numerous other advantageous of our bag based on the foregoing description.

Although this invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

INDUSTRIAL APPLICABILITY

The invention described herein can be used in the commercial production of storage bags. Such storage bags have a wide variety of uses, such as being utilized to store food, chemicals, or other substances.

We claim:

1. A storage bag comprising:

(A) a first sidewall having (a) a top edge, (b) a bottom edge, and (c) a bottom portion, the bottom portion being adjacent to the bottom edge of the first sidewall, and the bottom portion including (i) at least a first shift region and (ii) at least a second shift region, about which the bag is capable of shifting, each of the shift regions extending a distance along the first sidewall, and at least one of the shift regions comprising one of a score line, an indentation, and a crimp formed into the first sidewall; and (B) a second sidewall having (a) a top edge, (b) a bottom edge, and (c) a bottom portion, the second sidewall being connected to the first sidewall, the bottom portion being adjacent to the bottom edge of the second sidewall, and the bottom portion including (i) at least a first shift region and (ii) at least a second shift region, about which the bag is capable of shifting, each of the shift regions extending a distance along the second sidewall, and at least one of the shift regions comprising one of a score line, an indentation, and a crimp formed into the second sidewall, wherein the bag shifts between (a) a flat configuration with the first and second sidewalls positioned adjacent to each other, and (b) a stand-up configuration with the first and second sidewalls separated from each other, such that, in the stand-up configuration, the bag has a substantially flat base that is (i) formed by the bottom portion of the first sidewall and the bottom portion of the second sidewall, and (ii) outlined by at least one of the shift regions of the first sidewall and at least one of the shift regions of the second sidewall, and wherein (a) an angle $\alpha$ is defined between each of (i) the first shift region of the first sidewall and an adjacent edge of the bag and (ii) the first shift region of the second sidewall and an adjacent edge of the bag, and (b) an angle $\beta$ is defined between each of (i) the second shift region of the first sidewall and a bottom edge of the bag and (ii) the second shift region of the second sidewall and the bottom edge of the bag, such that (i) each angle $\alpha$ relates to a respective angle $\beta$ to facilitate the shifting of the bag between the flat configuration and the stand-up configuration, and (ii) each angle $\alpha$ differs from each angle $\beta$.

2. The storage bag according to claim 1, wherein at least one of the shift regions of the first sidewall and at least one of the shift regions of the second sidewall are one of changes in elevation and changes in thickness in portions of the respective first and second sidewalls of the bag.

3. The storage bag according to claim 1, wherein (i) the at least a first shift region of the first sidewall includes shift regions that extend from near a first corner of the bottom edge of the first sidewall, and (ii) the at least a second shift region of the first sidewall includes shift regions that extend from near a second corner of the bottom edge of the first sidewall, and wherein (i) the at least a first shift region of the second sidewall includes shift regions that extend from near a first corner of the bottom edge of the second sidewall, and (ii) the at least a second shift region of the second sidewall includes shift regions that extend from near a second corner of the bottom edge of the second sidewall.

4. The storage bag according to claim 1, wherein the first sidewall further includes an interlocking closure structure and the second sidewall further includes an interlocking closure structure, the interlocking closure structure of the first sidewall being configured to interlock with the interlocking closure structure of the second sidewall to seal an opening of the bag.

5. The storage bag according to claim 1, wherein at least one of the bottom portions of the first and second sidewalls comprises a visually distinct texture to facilitate a user in the shifting of the bag.

6. A storage bag comprising:

(A) a first sidewall having (a) a top edge, (b) a bottom edge, and (c) a bottom portion, the bottom portion being adjacent to the bottom edge of the first sidewall, and the bottom portion including (i) a first shift region about which the bag is capable of shifting, the first shift region extending a distance along the first sidewall, (ii) a second shift region about which the bag is capable of shifting, the second shift region extending a distance along the first sidewall, (iii) a third shift region about which the bag is capable of shifting, the third shift region extending a distance along the first sidewall, and (iv) a fourth shift region about which the bag is capable of shifting, the fourth shift region extending a distance along the first sidewall, wherein at least one of the first, second, third, and fourth shift regions of the first sidewall comprises one of a score line, an indentation, and a crimp formed into the first sidewall; and (B) a second sidewall having (a) a top edge, (b) a bottom edge, and (c) a bottom portion, the second sidewall being connected to the first sidewall, the bottom portion being adjacent to the bottom edge of the second sidewall, and the bottom portion including (i) a first shift region about which the bag is capable of shifting, the first shift region extending a distance along the second sidewall, (ii) a second shift region about which the bag is capable of shifting, the second shift region extending a distance along the second sidewall, (iii) a third shift region about which the bag is capable of shifting, the third shift region extending a distance along the second sidewall, and (iv) a fourth shift region about which the bag is capable of shifting, the fourth shift region extending a distance along the second sidewall, wherein at least one of the first, second, third, and fourth shift regions of the second sidewall comprises one of a score line, an indentation, and a crimp formed into the second sidewall, wherein the bag shifts between (a) a flat configuration with the first and second sidewalls positioned adjacent to each other, and (b) a stand-up configuration with the first and second sidewalls separated from each other, such that in the stand-up configuration, the bag has a substantially flat base that is (i) formed by the bottom portion of the first sidewall and the bottom portion of the second sidewall, and (ii) outlined by at least one of the shift regions of the first sidewall and at least one of the shift regions of the second sidewall, and wherein (a) an angle $\alpha$ is defined between each of (i) the first shift region of the first sidewall and an adjacent edge of the bag, (ii) the third shift region of the first sidewall and an adjacent edge of the bag, (iii) the first shift region of the second sidewall and an adjacent edge of the bag, and (iv) the third shift region of the second sidewall and an adjacent edge of the bag, and (b) an angle $\beta$ is defined between each of (i) the second shift region of the first sidewall and a bottom edge of the bag, (ii) the fourth shift region of the first sidewall and the bottom edge of the bag, (iii) the second shift region of the second sidewall and the bottom edge of the bag, and (iv) the fourth shift region of the second sidewall and the bottom edge of the bag, such that (i) each angle $\alpha$ relates to a respective angle $\beta$ to facilitate the shifting of the bag between the flat configuration and the stand-up configuration, and (ii) each angle $\alpha$ differs from each angle $\beta$.

7. The storage bag according to claim 6, wherein the first sidewall further includes a horizontal shift region that extends from a first edge of the bag to a second edge of the bag, with the first and second shift regions of the first sidewall extending from a first corner of the first sidewall to the horizontal shift region of the first sidewall, and with the third and fourth shift regions on the first sidewall extending from a second corner of the first sidewall to the horizontal shift region of the first sidewall, the bag being capable of shifting about the horizontal shift region of the first sidewall, and wherein the second sidewall further includes a horizontal shift region that extends from the first edge of the bag to the second edge of the bag, with the first and second shift regions of the second sidewall extending from a first corner of the second sidewall to the horizontal shift region of the second sidewall, and with the third and fourth shift regions of the second sidewall extending from a second corner of the second sidewall to the horizontal shift region of the second sidewall, the bag being capable of shifting about the horizontal shift region of the second sidewall.

8. The storage bag according to claim 7, wherein the horizontal shift region of the first sidewall is a distance H above the bottom edge of the bag when the bag is in the flat configuration, and the horizontal shift region of the second sidewall is a distance H above the bottom edge of the bag when the bag is in the flat configuration, and wherein the base, in the stand-up configuration, has a width of about 2H at a center portion of the base.

9. The storage bag according to claim 8, wherein the distance H is about two inches.

10. The storage bag according to claim 7, wherein the base, in the stand-up configuration, is outlined by the second shift region of the first sidewall, the horizontal shift region of the first sidewall, the fourth shift region of the first sidewall, the fourth shift region of the second sidewall, the horizontal shift region of the second sidewall, and the second shift region of the second sidewall.

11. The storage bag according to claim 7, wherein at least a portion of the first sidewall between the horizontal shift region of the first sidewall and the bottom edge of the bag is thicker than a portion of the first sidewall above the horizontal shift region of the first side wall, and wherein at least a portion of the second sidewall between the horizontal shift region of the second sidewall and the bottom edge of the bag is thicker than a portion of the second sidewall above the horizontal shift region of the second sidewall.

12. The storage bag according to claim 6, wherein the first sidewall includes a plurality of portions that is stiffer than adjacent portions of the first sidewall, and wherein the second sidewall includes a plurality of portions that is stiffer than adjacent portions of the second sidewall.

13. The storage bag according to claim 6, wherein the first, second, third, and fourth shift regions of the first and second sidewalls are one of straight lines and curved lines.

14. The storage bag according to claim 6, wherein the first sidewall further includes an interlocking closure structure and the second sidewall further includes an interlocking closure structure, the interlocking closure structure of the first sidewall being configured to interlock with the interlocking closure structure of the second sidewall to seal an opening of the bag.

15. The storage bag according to claim 6, wherein at least one of the bottom portions of the first and second sidewalls comprises a visually distinct texture to facilitate a user in the shifting of the bag.

16. A storage bag comprising:

(A) a first sidewall having (a) a top edge, (b) a bottom edge, and (c) a bottom portion, the bottom portion being adjacent to the bottom edge of the first sidewall, and the bottom portion including (i) at least a first shift region and (ii) at least a second shift region, about which the bag is capable of shifting, each of the shift regions extending a distance along the first sidewall, and at least one of the shift regions comprising one of a score line, an indentation, and a crimp formed into the first sidewall; and (B) a second sidewall connected to the first sidewall, the second sidewall having (a) a top edge, (b) a bottom edge, and (c) a bottom portion, the bottom portion being adjacent to the bottom edge of the second sidewall, wherein the bag shifts between (a) a flat configuration with the first and second sidewalls positioned adjacent to each other, and (b) a stand-up configuration with the first and second sidewalls separated from each other, such that, in the stand-up configuration, the bag has a substantially flat base that is (i) formed by the bottom portion of the first sidewall and the bottom portion of the second sidewall, and (ii) outlined by at least one of the shift regions of the first sidewall, and wherein (a) an angle α is defined between at least one of the shift regions of the first sidewall and an adjacent edge of the bag, and (b) an angle β is defined between at least one of the shift regions of the first sidewall and a bottom edge of the bag, such that (i) the angle α relates to the angle β to facilitate the shifting of the bag between the flat configuration and the stand-up configuration, and (ii) the angle α differs from the angle β.

17. The storage bag according to claim 16, wherein the second sidewall comprises at least a first shift region and at least a second shift region about which the bag is capable of shifting, each of the shift regions extending a distance along the second sidewall, and at least one of the shift regions comprising one of a score line, an indentation, and a crimp formed into the second sidewall.

18. The storage bag according to claim 17, wherein (a) an angle α is defined between at least one of the shift regions of the second sidewall and an adjacent edge of the bag, and (b) an angle β is defined between at least one of the shift regions of the second sidewall and the bottom edge of the bag, such that (i) the angle α defined between the at least one shift region of the second sidewall and the adjacent edge of the bag relates to the angle β defined between the at least one shift region of the second sidewall and the bottom edge of the bag to facilitate the shifting of the bag between the flat configuration and the stand-up configuration, and (ii) the angle α defined between the at least one shift region of the second sidewall and the adjacent edge of the bag differs from the angle β defined between the at least one shift region of the second sidewall and the bottom edge of the bag.

19. The storage bag according to claim 17, wherein each of the shift regions of the first and second sidewalls is one of straight lines and curved lines.

20. The storage bag according to claim 16, wherein, when the bag is in the stand-up configuration, the base includes triangular shaped regions that extend from corners at a bottom of the bag.

21. The storage bag according to claim 16, wherein the first sidewall further includes a horizontal shift region that extends from a first edge of the bag to a second edge of the bag, the bag being capable of shifting about the horizontal shift region of the first sidewall, and wherein the second sidewall further includes a horizontal shift region that extends from the first edge of the bag to the second edge of the bag, the bag being capable of shifting about the horizontal shift region of the second sidewall.

22. A storage bag according to claim 21, wherein the horizontal shift region of the first sidewall and the horizontal shift region of the second sidewall define edges of the base in the stand-up configuration.

23. The storage bag according to claim 21, wherein the horizontal shift region of the first sidewall is a distance H above the bottom edge of the bag when the bag is in the flat configuration, and the horizontal shift region of the second sidewall is a distance H above the bottom edge of the bag when the bag is in the flat configuration, and wherein the base, in the stand-up configuration, has a width of about 2H at a center portion of the base.

24. The storage bag according to claim 23, wherein the distance H is about two inches.

25. The storage bag according to claim 21, wherein at least a portion of the first sidewall between the horizontal shift region of the first sidewall and the bottom edge of the bag is thicker than a portion of the first sidewall above the horizontal shift region of the first sidewall, and wherein at least a portion of the second sidewall between the horizontal shift region of the second sidewall and the bottom edge of the bag is thicker than a portion of the second sidewall above the horizontal shift region of the second sidewall.

26. The storage bag according to claim 16, wherein the first sidewall includes a plurality of portions that is stiffer than adjacent portions of the first sidewall, and wherein the second sidewall includes a plurality of portions that is stiffer than adjacent portions of the second sidewall.

27. The storage bag according to claim 16, wherein the first sidewall further includes an interlocking closure structure and the second sidewall further includes an interlocking closure structure, the interlocking closure structure of the first sidewall being configured to interlock with the interlocking closure structure of the second sidewall to seal an opening of the bag.

28. The storage bag according to claim 16, wherein at least one of the bottom portions of the first and second sidewalls comprises a visually distinct texture to facilitate a user in the shifting of the bag.

29. A storage bag comprising:

(A) a first sidewall having (a) a top edge, (b) a bottom edge, and (c) a bottom portion, the bottom portion being adjacent to the bottom edge of the first sidewall, and the bottom portion including (i) at least a first shift region and (ii) at least a second shift region, about which the bag is capable of shifting, each of the shift regions extending a distance along the first sidewall, and at least one of the shift regions comprising one of a score line, an indentation, and a crimp formed into the first sidewall; and (B) a second sidewall having (a) a top edge, (b) a bottom edge, and (c) a bottom portion, the second sidewall being connected to the first sidewall, the bottom portion being adjacent to the bottom edge of the second sidewall, and the bottom portion including (i) at least a first shift region and (ii) at least a second shift region, about which the bag is capable of shifting, each of the shift regions extending a distance along the second sidewall, and at least one of the shift regions comprising one of a score line, an indentation, and a crimp formed into the second sidewall, wherein the bag shifts between (a) a flat configuration with the first and second sidewalls positioned adjacent to each other, and (b) a stand-up configuration with the first and second sidewalls separated from each other, such that, in the stand-up configuration, the bag has a substantially flat base that is (i) formed by the bottom portion of the first sidewall and the bottom portion of the second sidewall, and (ii) outlined by at least one of the shift regions of the first sidewall and at least one of the shift regions of the second sidewall, and wherein (a) a first angle is defined between at least one of the shift regions of the first sidewall and an adjacent edge of the bag, and (b) a second angle is defined between a bottom edge of the bag and at least one of the shift regions of the first sidewall, such that the first angle differs from the second angle.

30. The storage bag according to claim 29, wherein (a) a first angle is defined between at least one of the shift regions of the second sidewall and an adjacent edge of the bag, and (b) a second angle is defined between the bottom edge of the bag and at least one of the shift regions of the second sidewall, such that the first angle defined between the at least one shift region of the second sidewall and the adjacent edge of the bag differs from the second angle defined between the bottom edge of the bag and the at least one shift region of the second sidewall.

31. The storage bag according to claim 29, wherein each of the shift regions of the first and second sidewalls is one of straight lines and curved lines.

32. The storage bag according to claim 29, wherein, when the bag is in the stand-up configuration, the base includes triangular shaped regions that extend from corners at a bottom of the bag.

33. The storage bag according to claim 29, wherein the first sidewall further includes a horizontal shift region that extends from a first edge of the bag to a second edge of the bag, the bag being capable of shifting about the horizontal shift region of the first sidewall, and wherein the second sidewall further includes a horizontal shift region that extends from the first edge of the bag to the second edge of the bag, the bag being capable of shifting about the horizontal shift region of the second sidewall.

34. A storage bag according to claim 33, wherein the horizontal shift region of the first sidewall and the horizontal shift region of the second sidewall define edges of the base in the stand-up configuration.

35. The storage bag according to claim 33, wherein the horizontal shift region of the first sidewall is a distance H above the bottom edge of the bag when the bag is in the flat configuration, and the horizontal shift region of the second sidewall is a distance H above the bottom edge of the bag when the bag is in the flat configuration, and wherein the base, in the stand-up configuration, has a width of about 2H at a center portion of the base.

36. The storage bag according to claim 35, wherein the distance H is about two inches.

37. The storage bag according to claim 33, wherein at least a portion of the first sidewall between the horizontal shift region of the first sidewall and the bottom edge of the bag is thicker than a portion of the first sidewall above the horizontal shift region of the first sidewall, and wherein at least a portion of the second sidewall between the horizontal shift region of the second sidewall and the bottom edge of the bag is thicker than a portion of the second sidewall above the horizontal shift region of the second sidewall.

38. The storage bag according to claim 29, wherein the first sidewall includes a plurality of portions that is stiffer than adjacent portions of the first sidewall, and wherein the second sidewall includes a plurality of portions that is stiffer than adjacent portions of the second sidewall.

39. The storage bag according to claim 29, wherein the first sidewall further includes an interlocking closure structure and the second sidewall further includes an interlocking closure structure, the interlocking closure structure of the first sidewall being configured to interlock with the interlocking closure structure of the second sidewall to seal an opening of the bag.

40. The storage bag according to claim 29, wherein at least one of the bottom portions of the first and second sidewalls comprises a visually distinct texture to facilitate a user in the shifting of the bag.

* * * * *